US005689222A

United States Patent [19]

Schneider et al.

[11] Patent Number: 5,689,222

[45] Date of Patent: Nov. 18, 1997

[54] ELECTROMAGNETIC RELAY AND METHOD FOR THE PRODUCTION THEREOF

[75] Inventors: Siegfried Schneider, Leutershausen; Manfred Mitsch, Ansbach; Theodor Sturm, Sachsen, all of Germany

[73] Assignee: Robert Bosch GmbH, Stuttgart, Germany

[21] Appl. No.: 542,202

[22] Filed: Oct. 12, 1995

[30] Foreign Application Priority Data

Oct. 12, 1994 [DE] Germany ..... 44 36 404.0

[51] Int. Cl.[6] ..... H01H 51/22

[52] U.S. Cl. ..... 335/78; 335/80; 335/128

[58] Field of Search ..... 335/78–86, 124, 335/128

[56] References Cited

U.S. PATENT DOCUMENTS

| | | | |
|---|---|---|---|
| 4,267,540 | 5/1981 | Iketani | 335/128 |
| 4,870,378 | 9/1989 | Biehl et al. | 335/128 |
| 4,972,166 | 11/1990 | Mitsch et al. | 335/128 |

FOREIGN PATENT DOCUMENTS

| | | |
|---|---|---|
| 0374552 | 12/1989 | European Pat. Off. . |
| 2450247 | 10/1974 | Germany . |
| 2832507 | 7/1978 | Germany . |
| 3148052 | 12/1981 | Germany . |
| 3210031 | 3/1982 | Germany . |
| 2027277 | 2/1980 | United Kingdom . |

*Primary Examiner*—Lincoln Donovan

*Attorney, Agent, or Firm*—Edwin E. Greigg; Ronald E. Greigg

[57] ABSTRACT

An electromagnetic relay having a coil core which carries a coil. The coil is connected to one end to the short limb of an L-shaped magnet yoke, on a long limb of the L-shaped magnet, a hinged armature is supported in a manner which allows the armature to pivot about a pivot axis on the long limb of the magnet. In order to achieve a precisely defined switching behavior which is concurrent for the relays of a series, the length of the coil core is produced by means of upsetting as a function of the height of the pivot axis above a base area of the magnet yoke on which the coil core is secured, with the result that the position of the hinged armature with respect to a pole face of the coil core is precisely defined.

12 Claims, 1 Drawing Sheet

ELECTROMAGNETIC RELAY AND METHOD FOR THE PRODUCTION THEREOF

PRIOR ART

The invention is based on an electromagnetic relay and relates furthermore to a method for the production of such a relay.

A relay of this type is disclosed in DE 28 32 507 C2. The known relay has an essentially cylindrical coil core which is in the form of a rod or a pin, carries a coil and is riveted by one of its ends to the shorter limb of an L-shaped armature laminate. A hinged armature which carries relay contacts is arranged on the free end of the coil core in a manner which allows it to pivot about a pivot axis. It is held at a distance from the coil core by a spring and, when current flows through the coil, it is pulled over to the free end, forming a pole face, of the coil core counter to the spring force.

In order to ensure exact functioning of the relay and concurrent switching behavior of all the relays of a series, it is necessary to set the gap between the hinged armature and the coil core as a function of the position of the pivot axis of the hinged armature. Production and assembly tolerances have to be compensated by adjusting the individual parts of the relay. Adjustment is carried out in the known relay by precisely measuring the position of the pivot axis of the hinged armature and by bringing the coil core to the required length by wobble riveting of its free end. The core has already been riveted to the L-shaped magnet yoke during the wobble riveting, the coil has been put onto the coil core. The wobble riveting results in the formation of a flange at the free end of the coil core which simultaneously fixes the coil in the axial direction. The described wobble riveting has the disadvantage that it has to be carried out in a very precise manner in order to bring the coil core as exactly as possible to the required length. It gives rise to an inconsiderable outlay due to the necessary precision and thereby makes a significant proportional contribution to the relay production costs.

ADVANTAGES OF THE INVENTION

In the case of the relay according to the invention, use is made of a coil core whose length which is critical for the position of the hinged armature in relation to the coil core has already been adapted exactly to the required length prior to the connection of the coil core to the magnet yoke. Adjustment of the individual parts is unnecessary. The coil core of the relay according to the invention has a bearing face for bearing against the magnet yoke, which bearing face ensures that the coil core length which is critical for the position of the hinged armature in relation to the coil core does not change when the coil core is connected to the magnet yoke. The coil core can be connected to the magnet yoke by riveting, by screwing, by soldering, welding or bonding, for example.

The invention has the advantage that the wobble riveting, which must be carried out with high capital costs and with a high outlay, is dispensed with. Furthermore, the free end, forming a pole face, of the coil core is not machined any more after the coil core has been connected to the magnet yoke. Rejection due to surface faults such as abrasion or chips in the pole face as a result of its machining are omitted. A cycle time of one second or less is possible for the assembly of the relay according to the invention.

The invention relates to advantageous developments and improvements of the relay and of the method according to the invention for the production of such a relay.

The pole face of the coil core is preferably designed to have a convex camber in order to reduce magnetic holding forces (remanence) after switching off an electric current through the coil, so that the armature lifts off the pole face at the instant of switching off rather than with a delay, and so that, as has been known to happen, the armature does not stick permanently to the pole face of the coil core.

The magnet yoke preferably forms the pivot axis for the armature, with the result that the position of the armature in relation to the coil core is a function solely of the coil core, of the magnet yoke and of the armature itself and is not influenced by further relay parts such as, for example, a baseplate or the like.

In order to establish the required length of the coil core, it is sufficient, in accordance with claim 7 relating to refinements of the invention, to measure, in the direction of the axis of the coil core, the distance of the pivot axis, which is formed by the magnet yoke, from a base area of the magnet yoke on which the coil core is secured. Therefore, the height of the pivot axis above the base area of the magnet yoke is measured. To this end, only one dimension has to be measured on one part of the relay. This dimension is used to define the position of the armature in relation to the coil core, with the result that the required length of the coil core can be determined from this dimension.

The coil core is brought to the required length from its bearing face to the pole face by means of upsetting, the coil core being supported on the bearing face. Upsetting represents a rapid and simple method which can be used to bring the coil core exactly to the desired length.

BRIEF DESCRIPTION OF THE DRAWING

The invention is explained in more detail below with reference to the drawing, which illustrates an exemplary embodiment of a relay according to the invention as well as a method according to the invention for the production of such a relay.

DETAILED DESCRIPTION OF THE EXEMPLARY EMBODIMENT

Figure 1:
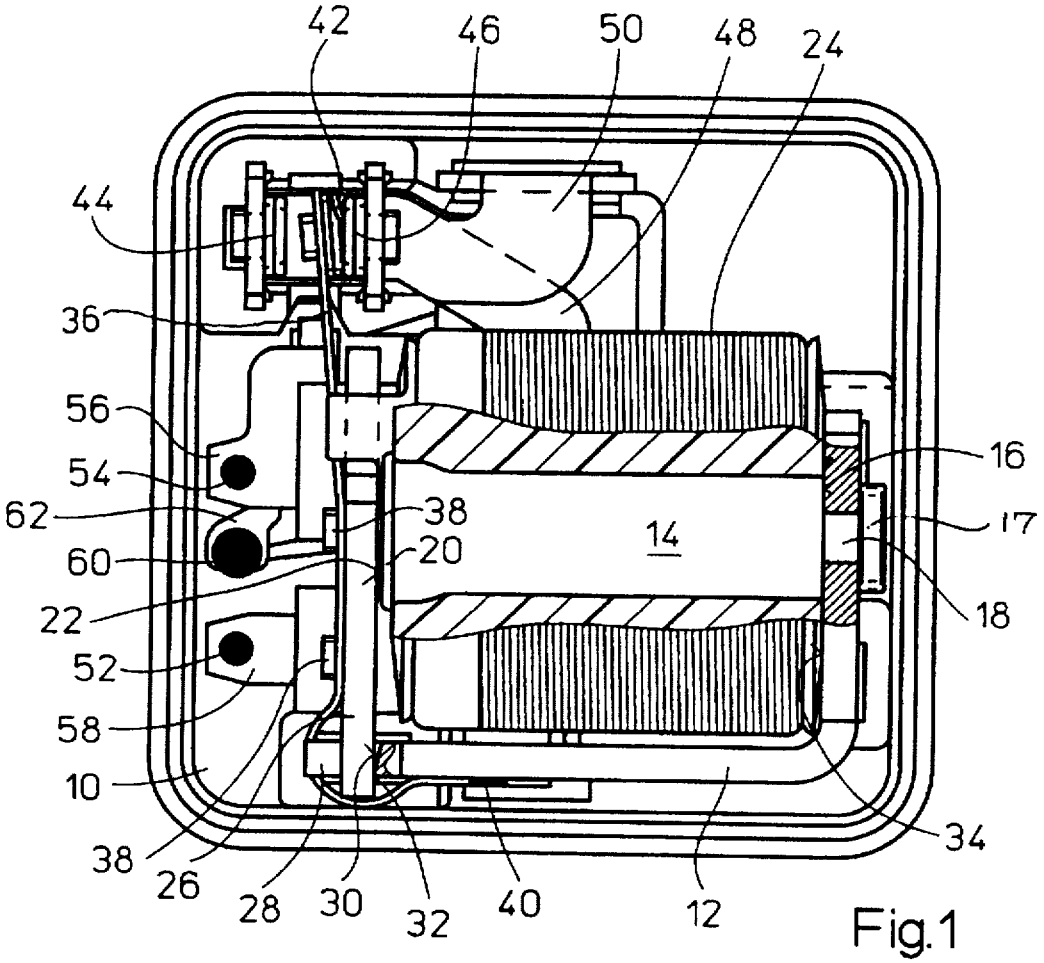
FIG. 1 shows a plan view of a relay according to the invention.

The relay illustrated in FIG. 1 has a base-plate 10 which is made of insulating material and on which an L-shaped magnet yoke 12, is secured. The magnet yoke is produced as a bent laminated part, having a short limb and a long limb. An essentially cylindrical coil core 14 is riveted to the shorter limb of the magnet yoke 12. At its end which is riveted to the magnet yoke 12, the coil core 14 has an annular shoulder area as the bearing face 16, which is arranged around a rivet pin 18 which is used for riveting the coil core 14 to the magnet yoke 12. The rivet head 17 secures the coil core to the shorter limb. At its free end, the coil core 14 has a flange 20 whose free end face is designed with a convex camber as the pole face 22 of the coil core 14.

The coil core 14 carries a coil 24 which is fixed in the axial direction between the short limb of the L-shaped magnet yoke 12 and the flange 20 of the coil core 14.

At the free end of the longer limb of the magnet yoke 12, a hinged armature 26 is supported so that it can pivot in a recess 28 in the magnet yoke 12. In order to achieve a precisely defined pivot axis 32 for the hinged armature 26, a base area 30 of the recess 28 is produced with an inclination with respect to the longitudinal direction of the longer limb of the magnet yoke 12.

The length l (FIG. 2) of the coil core 14 from its bearing face 16 to its pole face 22 is matched for the relay exactly to a height h (FIG. 3) of the pivot axis 32 above a base area 34 of the shorter limb of the magnet yoke 12, against which the coil core 14 bears with its bearing face 16. As a result, the position of the hinged armature 26 in relation to the coil core 14, in particular to the pole face 22 thereof, is defined exactly, and this is imperative for exact functioning of the relay according to the invention and particularly for a concurrent response behavior of relays, according to the invention, of a production series.

A leaf spring 36 extends arcuately around the free end of the longer limb of the magnet yoke 12 and that end of the hinged armature 26 supported therein. The leaf spring 36 is connected to the hinged armature 26 by means of two rivets 38. It is connected to the longer limb of the magnet yoke 12 by a spot weld 40. The leaf spring 36 lifts the hinged armature 26 off the pole face 22 of the coil core 14. FIG. 1 illustrates a position of the hinged armature 26 in which it is bearing against the pole face 22 and into which it pivots, when current flows through the coil 24, on account of a magnetic force counter to the spring force of the leaf spring 36.

The leaf spring 36 extends beyond a free end of the hinged armature 26. It is used as a carrier for a movable twin contact 42 of the electromagnetic relay according to the invention. The twin contact 42 is situated between two fixed contacts 44, 46 of the relay which are connected to the baseplate 10 by means of laminated tongues 48, 50. FIG. 1 illustrates the switching position of the relay in which the twin contact 42 bears against one of the two stationary contacts 46. In a quiescent position (not illustrated) of the relay, the twin contact 42 comes to bear against the other stationary contact 44. The two laminated tongues 48, 50 are passed through the baseplate 10 for the electrical connection of the relay, this not being visible in the drawing.

The coil 24 is electrically conductively connected by means of soldering points 52, 54 to two laminated tongues 56, 58 which are likewise passed through the baseplate 10 for the purpose of electrical connection (not visible). In the same way, the twin contact 42 is electrically conductively connected via the leaf spring 36 to a soldering point 60 of a laminated tongue 62 which is likewise passed through the baseplate 10.

Method for the production of the relay according to the invention

Figure 2:
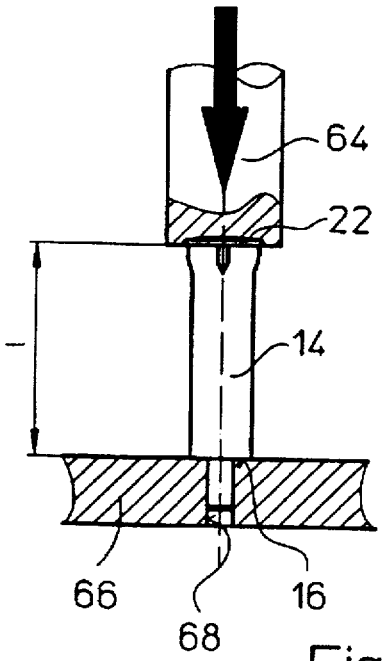
FIG. 2 shows the upsetting of a coil core for a relay according to the invention.
Figure 3:
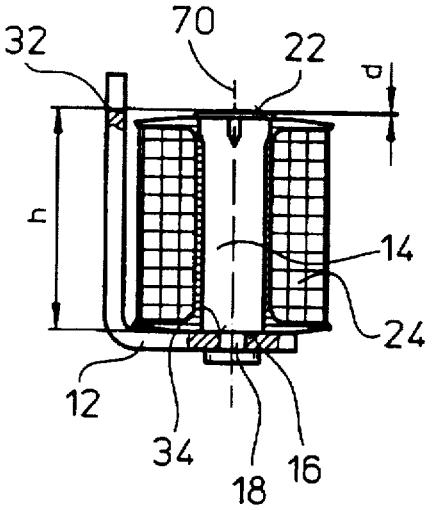
FIG. 3 shows the coil core from FIG. 2, a coil and a magnet yoke in the assembled state.

The method for the production of the relay according to the invention is explained with reference to FIGS. 2 and 3. First of all, an exact measurement is made of the height h of the pivot axis 32, formed at the end of the longer limb of the L-shaped magnet yoke 12, for the hinged armature 26 above the base area 34 on the shorter limb of the magnet yoke 12 (FIG. 3). This height h determines the length l of the coil core 14 from its bearing face 16 to its pole face 22. The required length l is exactly produced for the relay by upsetting the coil core 14 with a punch 64 (FIG. 2). During the upsetting operation, the coil core 14 is supported by its bearing face 16 on a dolly 66, which has a bore 68 for the rivet pin 18 of the coil core 14.

After the coil core 14 has been brought exactly to the required length l, it is inserted through the coil 24 and riveted to the shorter limb of the magnet yoke 12. In this case, only the rivet pin 18 of the coil core 14 is deformed, the length l of the coil core 14 is not changed. A distance d between the pivot axis 32 and the pole face 22 in the direction of a longitudinal axis 70 of the coil core 14 is defined precisely and identically for each relay of a series by means of the production method according to the invention, irrespectively of tolerances in the production of the individual parts. Consequently, the subsequent position of the hinged armature 26 in relation to the coil core 14 and its pole face 22 is also precisely predetermined. The foregoing relates to preferred exemplary embodiments of the invention, it being understood that other variants and embodiments thereof are possible within the spirit and scope of the invention, the latter being defined by the appended claims.

We claim:

1. An electromagnetic relay having a coil core, which carries a surrounding coil with one end of said coil core connected to a magnet yoke (12), wherein a length (l) of the coil core (14) between a bearing face (16) of the coil core (14) on the magnet yoke (12) and a pole face (22) remote from the bearing face (16) corresponds with a height h of the pivot shaft (32) of a hinged armature (26) of the relay above a base surface (34), formed by a short leg of the magnet yoke (12) in which surface the coil core (14) rests with the bearing face (16), and wherein this length (l) of the coil core (14) remains unchanged when the magnet yoke, the coil core, a coil and the armature of the relay are connected to one another.

2. The relay as claimed in claim 1, wherein the coil core (14) is designed to be essentially cylindrical with a flange at a first end and changes into a rivet pin (18) at a second end which includes an annular shoulder that forms the bearing face (16).

3. The relay as claimed in claim 1, wherein a pole face (22) of the coil core (14) has a convex camber at the flange end.

4. The relay as claimed in claim 2, wherein a pole face (22) of the coil core (14) has a convex camber at the flange end.

5. The relay as claimed in claim 1, wherein the magnet yoke (12) is of L-shaped design.

6. The relay as claimed in claim 2, wherein the magnet yoke (12) is of L-shaped design.

7. The relay as claimed in claim 3, wherein the magnet yoke (12) is of L-shaped design.

8. The relay as claimed in claim 1, wherein the armature (26) is supported so that it pivots on the magnet yoke (12).

9. The relay as claimed in claim 2, wherein the armature (26) is supported so that it pivots on the magnet yoke (12).

10. The relay as claimed in claim 3, wherein the armature (26) is supported so that it pivots on the magnet yoke (12).

11. A method for the production of a relay which has a coil core (14) carrying a coil 24), a magnet yoke (12) and an armature (26), which comprises precisely measuring said coil core, said magnet yoke, and said armature of the relay and producing the coil core (14) with a length (l) between a bearing face (16) of the coil core (14) on the magnet yoke (12) and a pole face (22) remote from the bearing face (16) and adapting the length (l) to a height (h) of a pivot shaft (32) of said armature above a base surface (34) formed by a short leg of the magnet yoke on which surface the coil core (14) rests with the bearing face (16), as a function of the measurement and before the coil core (14) is connected to the magnet yoke (12).

12. The method as claimed in claim 11, wherein the distance (h) of a base area (34) of the magnet yoke (12), which base area is provided to bear against the bearing face (16) of the coil core (14), from a pivot axis (32) of the armature (26) in an axial direction of the coil core (14) is determined by precisely measuring the magnet yoke (12), the coil core (14) and the armature of the relay, and wherein the coil core (14) is produced with a length (l) from the bearing face (16) to an end remote from the bearing face (16) as a function of this distance (h).

* * * * *